United States Patent [19]

Osawa et al.

[11] Patent Number: 4,629,673

[45] Date of Patent: Dec. 16, 1986

[54] RESIN-COATED CARRIER FOR USE IN TWO-COMPONENT ELECTROPHOTOGRAPHIC DEVELOPERS

[75] Inventors: Shigenobu Osawa; Tamotsu Murakami; Takashi Mizuma, all of Kawasaki; Katsuhide Sano, Yokohama, all of Japan

[73] Assignee: Kabushiki Kaisha Toshiba, Kanagawa, Japan

[21] Appl. No.: 741,116

[22] Filed: Jun. 4, 1985

[30] Foreign Application Priority Data

Jun. 5, 1984 [JP] Japan ..... 59-114914

[51] Int. Cl.[4] ..... G03G 9/10

[52] U.S. Cl. ..... 430/108; 430/137; 430/106.6

[58] Field of Search ..... 430/137, 110, 106.6, 430/107, 108

[56] References Cited

U.S. PATENT DOCUMENTS

| | | | |
|---|---|---|---|
| 4,287,287 | 9/1981 | Bolte et al. | 430/137 |
| 4,526,851 | 7/1985 | Boughton et al. | 430/106.6 |
| 4,543,312 | 9/1985 | Murakawa et al. | 430/111 |

*Primary Examiner*—John L. Goodrow

*Attorney, Agent, or Firm*—Schwartz, Jeffery, Schwaab, Mack, Blumenthal & Evans

[57] ABSTRACT

A carrier for use as a component in electrophotographic two-component developers having improved mechanical strength, durability and triboelectric charge characteristics comprising porous magnetite particles coated with a cross linked polymeric film comprising an epoxy resin and a polyamide resin. A two-component electrophotographic developer comprising resin coated porous magnetite carrier particles and toner particles and a method of producing resin coated porous magnetite carrier particles are also disclosed.

14 Claims, 2 Drawing Figures

RESIN-COATED CARRIER FOR USE IN TWO-COMPONENT ELECTROPHOTOGRAPHIC DEVELOPERS

BACKGROUND OF THE INVENTION

This invention relates to a resin-coated carrier for use in two-component electrophotographic developers comprising a carrier component together with a toner component.

In one of the electrophotographic methods, a dry, two-component developer comprising a toner component in combination with a carrier component is used in the magnetic brush developing method to render visible an electrostatic latent image formed on a photoreceptor.

Generally, the developer comprises a mixture of relatively fine toner particles and relatively coarse carrier particles. The electrostatic attractive force between the opposite polarities generated by contact of these particles holds the fine toner particles on the surface of the coarse carrier particles. When the thusly charged developer is brought into contact with the electrostatic latent image formed on the photoreceptor, part of the charged toner particles are electrostatically attracted and deposited on the latent image to produce a corresponding visible image.

Therefore, the toner particles should have an appropriate triboelectric property so that they hold a sufficient charge to ensure the selective deposition of the toner particles of the latent image.

In the magnetic brush developing method, carrier particles carrying the toner particles are attracted to a magnet roll to form a magnetic brush thereon. The magnetic brush contacts the latent image formed on the photoreceptor as the magnet roll rotates. The carrier particles serve to carry the toner particles to transport them to a developing area of the photoreceptor. As such carrier particles, iron oxide, magnetite or ferrite particles have heretofore been used, and these particles are coated with a resin film.

The carrier particles mentioned above, however, have a high apparent density which increases the required torque for rotating the magnet roll of the developing device. In addition, the specific surface area of the carrier particles is small. Consequently, the retention ratio of toner on the carrier particles may not be increased, and a lower retention ratio of toner may result in unnecessary deposition of toner on the area where the latent image is not formed. Consequently, the quality of the final reproduced copies becomes poor due to the soiling of the background with a significant amount of toner. This is called fog.

SUMMARY OF THE INVENTION

Accordingly, it is an object of the present invention to provide an improved electrophotographic carrier which may produce a clear developed image.

It is a further object of the present invention to provide an improved electrophotographic carrier which has a high specific surface area and a low apparent density.

It is a still further object of the present invention to provide an improved electrophotographic carrier which comprises a core particle coated with a resin film having high mechanical strength and adhering strongly to the core.

The above and other objects are achieved by providing a carrier for use in a two-component electrophotographic developer which comprises a core particle comprising porous magnetite and coated with a resin film.

In another aspect of the present invention, the objects are achieved by providing a two-component electrophotographic developer comprising a mixture of: a carrier formed of porous magnetite core particles coated with a resin film, and toner particles having a triboelectric charge property to be deposited on an electrostatic latent image.

According to still another aspect of the present invention, the objects are achieved by providing a method of preparing a carrier for use in a two-component electrophotographic developer comprising the steps of: burning iron oxide particles at a temperature lower than the temperature of complete crystallization, and coating the particles with a resin film.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, in which.

DETAILED DESCRIPTION OF THE PREFERRED EMBODIMENTS

Figure 1:
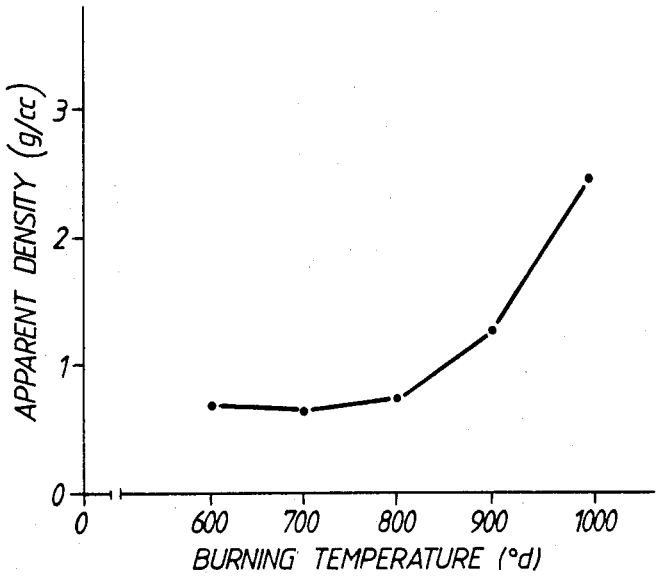
FIG. 1 is a graph showing the relation between the apparent density of magnetite particles and the burning temperature of red iron oxide.

Porous magnetite particles may be obtained by burning red iron oxide at a temperature lower than the temperature of complete crystallization (about 1,000° C.). When particles of red iron oxide are burned in an electric furnace at a temperature of 700° to 800° C. for one hour, the crystal growth of the particles does not proceed to completion. As a result, porous magnetite particles are obtained. The porous magnetite particles have a low apparent density as shown in FIG. 1. The particles also have a high specific surface area, so that they are suitable for use as a component in electrophotographic two-component developers. The porous magnetite particles, however, have a low breaking strength so that they are readily crushed by stirring in the developing device for only a few hours.

We have now found that the porous magnetite particles may be rendered suitable for use as an electrophotographic carrier by coating the particles with a resin film so as not to fill the microporous surface of the particles. As the method of coating the porous magnetite particles with resin film, the procedure disclosed in U.S. Pat. No. 4,486,502 may be used. Namely, the porous magnetite particles may be coated by spraying a resinous coating solution onto a fluidized bed of the particles. This is referred to as the spray dry method. Alternatively, it is possible to coat the porous magnetite particles by briefly immersing them in a resin coating solution.

The resin film coated on the particles may comprise any cross linkable resin or resin mixture which has sufficient breaking strength to prevent breakdown of the porous magnetite particles. A particularly preferred example of a resin film which may be applied to the porous magnetite particles is a cross linkable polymer film comprising an epoxy resin and a polyamide resin. Such a composition is particularly desirable because of its durability.

Commercially available epoxy resins suitable for the present coating composition include epoxy resins of the bisphenol-A type with a molecular weight of 300 to 4,000 (for example, sold under trade names of Epicoat 1001, 1004, 1007, 1009, 1031, 828 or 836 by Shell Chemical Co., Ltd.) Commercially available polyamide resins suitable for the present coating composition include polycondensation products of dimer acids and polyethylenepolyamines (for example, sold under the trade names Versamid 100, 115, 125 and 140 by General Mills Co., Ltd., Tomaid 215, 225 and 245 by Fuji Kaser' Co., Ltd. and Hitamide 410 and 420 by Hitachi Chemical Co., Ltd.).

Mixtures of epoxy resin and polyamide resin containing about 50 to 120 parts by weight of the polyamide resin for 100 parts by weight of the epoxy resin may suitably be used. The coating compositions may also contain, if desired, an aromatic amine or aromatic amine derivative as an auxiliary hardener.

The cross linked polymeric film may be formed by coating a solution containing the epoxy resin and the polyamide resin on the surface of the porous magnetite particles and drying the coated film at ambient temperature. To obtain an enhanced effect of the invention, a heat treatment may optionally be carried out at a temperature of about 100° to 150° C. for about 30 to 90 minutes after coating. The proportion of the resin film coated on the porous magnetite particles is preferably about 0.5 to 6% by weight of the porous magnetite particles.

If the proportion of the resin film is less than about 0.5% by weight, the thickness of the cross linked polymeric film may be too thin to produce sufficient breakdown strength of the carrier.

If the proportion of the resin film exceeds about 6% by weight, on the other hand, the microporous surface of the magnetite particles may be filled by the coating, so that the specific surface area of the carrier is undesirably decreased. When the resin film is formed by the spray dry method as described above, the total concentration of the resins in the coating solution is preferably in the range from about 2 to 10% by weight of the solution. Solutions having concentrations in this range generally provide a suitable balance between the flowability suitable for handling the solution and the acceptable efficiency obtained in the heating-drying step.

The present invention will be described further with reference to the following Examples which should not be considered as limitations on the present invention.

EXAMPLE

First, 3,500 parts by weight of water were added to 3,500 parts by weight of commercially available red iron oxide, and the mixture of water and red iron oxide was kneaded in a mixer to form a slurry. The slurry was then spray dried to form particles. The resulting particles had a particle size in the range from about 20 to about 250 μm. The particles were then burned in an electric furnace at a temperature of 800° C. for one hour. Furnace treatment was terminated before the crystal growth of the particles had proceeded to completion so that porous magnetite particles were obtained.

The porous magnetite particles were classified by means of a 100-mesh sieve and a 25-mesh sieve to obtain a porous magnetite particle fraction with diameters in the range of about 63–145 μm. The apparent density of the magnetite particles in the resulting fraction was 0.73 g/cc.

A coating solution was prepared by dissolving 10 parts by weight of an epoxy resin "Epicoat 1004" (Shell Chemical Co., Ltd.) and 6 parts by weight of a polyamide resin "Versamide 100" (General Mills Co., Ltd.) in 20 parts by weight of xylene and 10 parts by weight of n-butanol. The resulting solution was diluted with 150 parts by weight of methyl ethyl ketone to obtain a coating liquid.

A fluidized bed coating apparatus was charged with 1,300 parts by weight of the porous magnetite described above, and the above prepared coating liquid was sprayed into the fluidized bed using an air stream. After this coating step, the particles were heat-treated at 120° C. for one hour to cause cross linking of the coating.

A developer was prepared by mixing 1000 parts by weight of the resin-coated particles and 40 parts by weight of a commercially available toner for the magnetic brush developing method (designated for use in a "TOSHIBA BD-5511" copying machine) in a 1 liter polyethylene bottle for 90 minutes at 110 r.p.m. The amount of charging of the developer comprising the carrier and the toner prepared in this way is measured using a blow-off triboelectric charge measurement apparatus (for example, "TB-200" sold by Toshiba Chemical Co., Ltd.), and is found to be 24.5 microcoulombs/gram. The toner which is used in combination with the present carrier may be selected from the wide range of conventional toners which comprise a binder, a colorant and any optional additives.

When the developer was used to develop an electrostatic latent image formed on a selenium photoreceptor, the reproduced visual image was free from fog and had a high resolution. Even after reproduction of 100,000 copies, the charge of the developer is stable and is 26.3 microcoulombs/gram.

Figure 2:
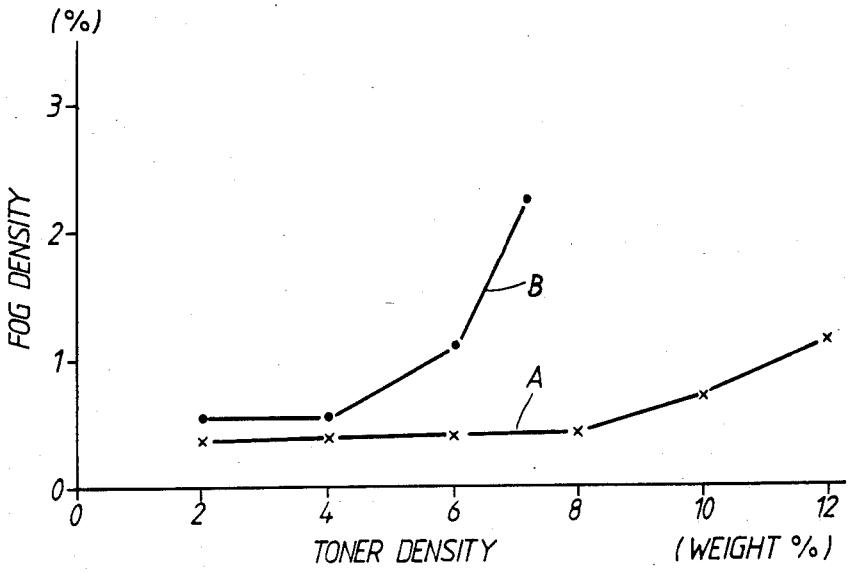
FIG. 2 is a graph showing the relation between fog density and toner density.

FIG. 2 shows the relationship between toner density and fog density of electrophotographic developers.

Generally, toner density in percent is determined by dividing the weight of the toner by the total weight of the toner plus the carrier and multiplying by 100%. The fog density is defined by optical density of fog image against the background. Curve "A" shows the characteristic of the developer according to the present invention. The acceptable range of toner density with respect to fog density extends up to about 10% by weight as shown in FIG. 2. Further, the torque required to start the rotation of the magnet roll was only 1.4 gram-force per cm when the above prepared developer including the carrier according to the invention was used in a magnetic brush developing device.

COMPARATIVE EXAMPLE

A carrier was prepared in accordance with the procedure as described in the foregoing Example except that red iron oxide was burnt at 1,000° C. so that nonporous particles were produced. A developer was prepared and used for developing the electrostatic image by the same procedure used in the foregoing Example. A clear image was reproduced during the initial stage, however, the produced image became foggy and unclear after reproduction of 100,000 copies. Curve B in FIG. 2 shows the characteristic of the developer according to this Comparative Example. The acceptable range of toner density with respect to fog density is less than about 5% by weight. Further, the torque required for starting the rotation of the magnet roll was 3.4 gram-force per cm using the developer of the Comparative Example.

As described above, according to the present invention it is possible to provide an improved carrier for electrophotographic developers, which has sufficient mechanical strength to withstand stress encountered in a developing device, permits reduction of the apparent density and increase of the specific surface area, broadens the acceptable range of toner density, and may reduce the starting torque required for the developing device.

Numerous modifications and variations of the present invention are possible in light of the above teachings. It is therefore to be understood that within the scope of the appended claims, the invention may be practiced otherwise than as specifically described herein.

What is claimed is:

1. A carrier for use in a two-component electrophotographic developer which comprises a core particle comprising porous magnetite coated with a resin film, said core particle being the reaction product of a process which includes the step of burning iron oxide at a temperature of from about 700° to about 800° C.

2. A carrier as claimed in claim 1, wherein iron oxide is red iron oxide.

3. A carrier as claimed in claim 1, wherein said resin film is a cross linked polymeric film.

4. A carrier as claimed in claim 3, wherein said cross linked film comprises an epoxy resin and a polyamide resin.

5. A carrier as claimed in claim 1, wherein the proportion of said resin film is about 0.5 to 6% by weight of said core particle.

6. A two-component electrophotographic developer comprising a mixture of:

a carrier formed of porous magnetite core particles coated with a resin film, said core particle being the reaction product of a process which includes the step of burning iron oxide at a temperature of from about 700° to about 800° C.; and toner particles having a triboelectric charge property to be deposited on an electrostatic latent image.

7. A two-component electrophotographic developer as claimed in claim 6, wherein the toner density lies in the range from about 5% to 10%.

8. A two-component electrophotographic developer as claimed in claim 6, wherein said resin film is a cross linked polymeric film.

9. A two-component electrophotographic developer as claimed in claim 8, wherein said cross linked polymeric film comprises an epoxy resin and a polyamide resin.

10. A method of preparing a carrier for use in a two-component electrophotographic developer comprising the steps of:

(a) burning iron oxide particles at a temperature of from about 700° to about 800° C.; and (b) coating said particles with a resin film.

11. A method as claimed in claim 10, wherein said resin film comprises an epoxy resin and a polyamide resin.

12. A method as claimed in claim 10, further comprising the step of cross linking the resin coating on said particles.

13. A method as claimed in claim 12, wherein said cross linking step is effected by heat-treating the resin coated particles.

14. A method according to claim 10, wherein said iron oxide is red iron oxide.

* * * * *